United States Patent [19]

Wittstock

[11] Patent Number: 4,962,616

[45] Date of Patent: Oct. 16, 1990

[54] METHOD AND DEVICE FOR CONTROLLING THE OPERATION OF HONING MACHINES

[75] Inventor: Gerhard Wittstock, Uetersen, Fed. Rep. of Germany

[73] Assignee: Peter Wolters AG, Rendsburg, Fed. Rep. of Germany

[21] Appl. No.: 355,030

[22] Filed: May 22, 1989

[30] Foreign Application Priority Data

May 28, 1988 [DE] Fed. Rep. of Germany ..... 3818159

[51] Int. Cl.[5] ..... B24B 49/05

[52] U.S. Cl. ..... 51/165.71; 51/132; 51/131.3; 51/283 R

[58] Field of Search ..... 51/165.74, 165.83, 165.91, 51/165.71, 131.3, 132, 283 R

[56] References Cited

U.S. PATENT DOCUMENTS 3,350,817 11/1967 Kiso et al. ..... 51/165.74
3,828,439 8/1974 Ishikawa et al. ..... 51/165.83
4,459,783 7/1984 Odell, II et al. ..... 51/165.74
4,539,777 9/1985 Brown et al. ..... 51/165.91

*Primary Examiner*—Frederick R. Schmidt
*Assistant Examiner*—Mark F. Frazier
*Attorney, Agent, or Firm*—Faegre & Benson

[57] ABSTRACT

Method for controlling the operation of two-wheel housing machines, the machining wheels of which are pressed towards each other and onto the workpieces by means of a loading device at a predetermined variable loading pressure, wherein during operation the material removal of the work-pieces and eventually the machining wheels is determined by means of a measuring control device and the operation is discontinued when a predetermined value has been reached, wherein the material removal per time unit (actual value) is determined and compared with at least one predetermined value for the material removal per time unit and the loading pressure for the loading device is automatically increased when the actual value is below the predetermined value.

31 Claims, 1 Drawing Sheet

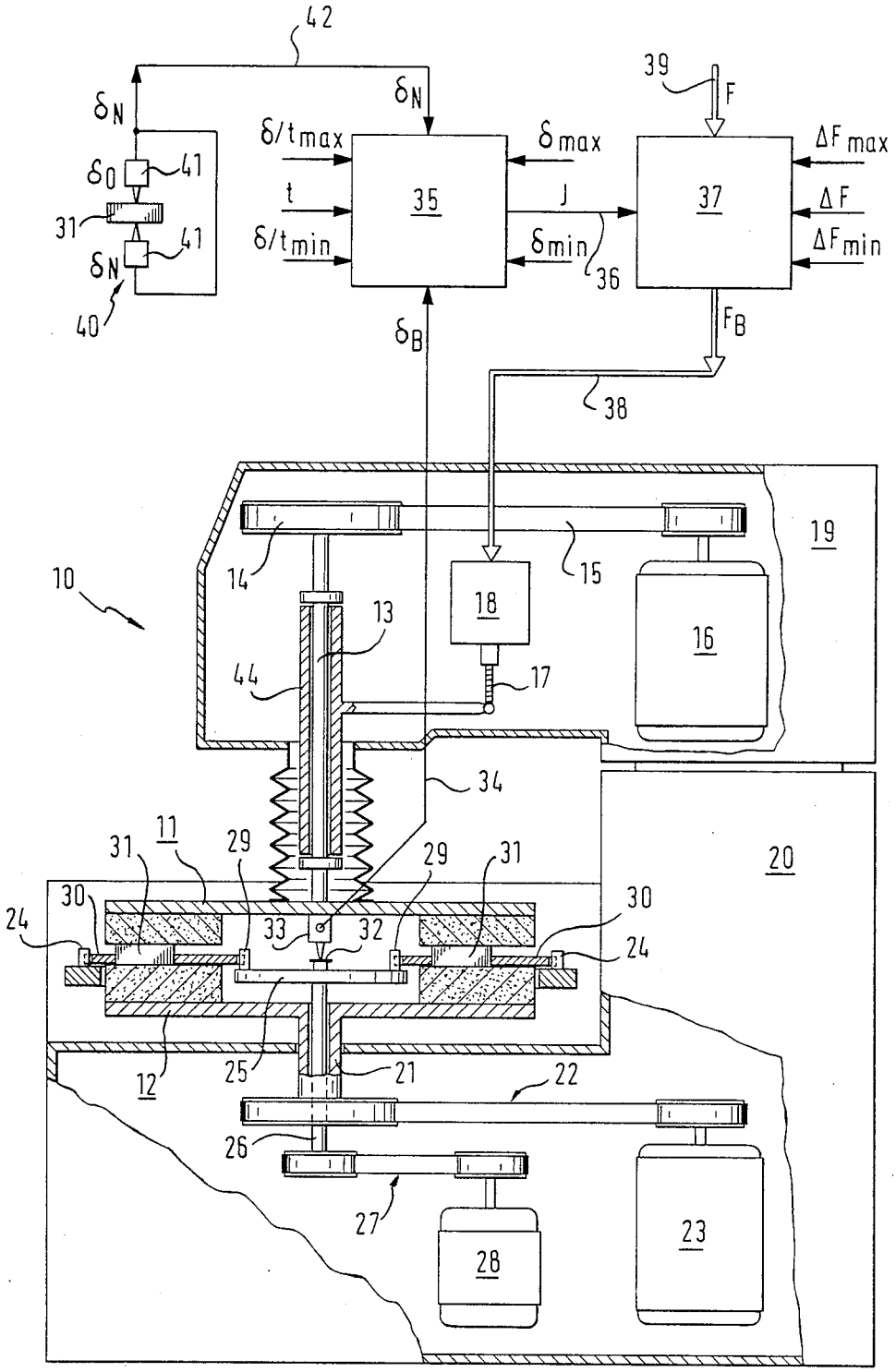
42
39
F
δN
δN
δ/tmax
δmax
ΔF max
δ0
41
35
37
t
J
ΔF
31
41
δ/tmin
δmin
ΔFmin
δN
36
40
δB
FB
38
19
14
15
10
18
16
13
44
17
34
11
29
29
31
31
20
30
30
24
33
32
24
12
25
21
22
26
27
28
23

METHOD AND DEVICE FOR CONTROLLING THE OPERATION OF HONING MACHINES

The invention relates to a method for controlling the operation especially of two-wheel honing machines in accordance with the preamble of claim 1.

In two-wheel honing and lapping machines, the workpieces normally are received in receiving apertures of the runner wheels which are supported on the lower machining wheel and the outer toothing of which is in engagement with an inner and an outer ring gear. The outer or inner ring gear or both, respectively, are driven such that the runner wheels rotate about their axis and move ahead between the machining wheels. The receiving apertures for the workpieces are eccentric such that the workpieces in their orbit as described move on a cycloidal path.

In the very fine surface machining of the workpieces, it is of importance among others that a predetermined thickness is maintained very accurately. Therefore, it is necessary during the operation of the machine tool to determine the thickness of the workpieces by means of a sensor. The sensor is preadjusted at a predetermined thickness. It will switch off the machine after the predetermined value has been reached. As the determination of thickness normally is attained in that the distance between the machining surfaces of the machining wheels is determined while on the other side, the machining wheels are subject to wear, it is necessary to consider this wear when determining the thickness. In prior art, this is attained in that the workpieces are checked outside of the machine tool. On basis of the checked values, from time to time an adjustment of the switch point for the sensor is accomplished.

When the wear of the machining wheels goes on, also their capacity for removal will change. This will become smaller and smaller as the machining wheels will lose their grip. The granular structure will be more and more smeared and the machining surface will get "blunter". As a matter of fact, for this reason the time of operation will increase. When the machining wheel will lose a large portion of its grip, the operation time will get too long which for reason of production is not satisfactory. On the other side, the effect as described can be compensated by continuously increasing the loading pressure. Thereby, it is possible to limit the duration of the time of operation. When the loading pressure surpasses predetermined values under circumstances it may be possible that sufficient surface quality and the necessary quality of tolerances is no longer reached. When the pressure is too high, the wheels will "break" open which means that the grip under certain conditions will increase.

In normal operation of honing machines, the loading pressure will be increased by the operator when he determines that the times of operation will become too long. Such a method, however, is not satisfactory and is dependent on the skill and reliability of the operator when satisfactory results have to be achieved.

Therefore, it is an object of the invention to provide a method for controlling the operation of two-wheel honing machines wherein the time of operation for the workpieces may be optimized while improving the quality of tolerances and surfaces with a simplified machine operation.

This object is attained by the features of the characterizing portion of claim 1.

In the method according to the invention, the removal of material per time unit is determined and compared with a predetermined value for the material removal per time unit. With other words, the change of thickness of the workpiece per time is measured during the time of operation and put into relation with a predetermined change of thickness per time. When the determined material removal per time unit does not reach the predetermined value, this is an indication for the decrease of the grip of the machine wheels. Therefore, it is necessary to increase the loading pressure. This is accomplished automatically in the method according to the invention.

It is also possible in the method according to the invention to predetermine a maximal and a minimal predetermined value for the material removal per time unit. The loading pressure is increased when the determined material removal per time unit is below the minimal predetermined value and decreased when it is above the maximal predetermined value, for instance at a breaking up of the machining wheels. In this way, it is ensured that the loading pressure is not too high nor too low in order to attain an optimal machining of the workpiece.

In the method according to the invention, it is possible to continuously vary the loading pressure depending on the material removal per time unit, e.g. to adjust the loading pressure immediately on a change of the determined value for the material removal per time unit. In an alternate embodiment of the invention, the loading pressure is changed after the completion of a working cycle prior to the next working cycle.

According to a further embodiment of the invention, it is possible in the method according to the invention to have the magnitude of the change of the loading pressure dependent on the magnitude of the deviation of the actual value from the predetermined value for the material removal per time unit. The control for the loading pressure can be provided with a function which is a relation of the loading pressure to the determined material removal per time unit. A certain value of the removal per time unit will relate to a certain loading pressure. When the material removal changes, also the loading pressure will correspondingly change. This can be accomplished infinitely or in predetermined steps.

In the method according to the invention, the machine tool is preferably switched off when the loading pressure will reach a predetermined value. As has been mentioned before, the quality of machining is no longer guaranteed above a certain value of the loading pressure. Furthermore, it is provided in the method according to the invention to send an alarm signal after reaching the maximal predetermined value for the material removal per time unit. The surpassing of this predetermined value indicates that the machining wheel may break open and eventually will gain an intolerable grip which is not desirable for quality reasons either.

One possibility to consider the wear of the machining wheels is according to the invention that the thickness of the workpieces will be checked after removing them from the machine and a correction signal is formed from the difference between the checked value and the predetermined value which correction signal is used for modifying the predetermined value for the material removal. As an alternative, also the switch off point of the machine can be shifted after reaching the predetermined value for the material removal. Prior to the input of a correction signal for modifying the predetermined value for the material removal, it is useful according to an embodiment of the invention to determine a plurality of check values on basis of which a mean value is formed.

A device according to the invention for attaining the method according to the invention provides a sensor with the associated measuring control device for determining the material removal of the workpieces and eventually of the machine wheels as well as a loading device for variably adjusting the loading pressure preferably of the upper machining wheel. According to the invention, an electronic measuring control device is provided which contains a programmable storage wherein at least one predetermined value for the material removal per time unit and for the absolute material removal is inserted Furthermore, it comprises a time impulse generator for determining the material removal per time unit. The sensor is connected with the measuring control device for the input of a signal corresponding with the material removal value detected. The measuring control device is connected with a pressure control device which depending on the signal of the control device will vary the loading pressure. For practical reasons, also the pressure control device will comprise a programmable storage for predetermining a maximal predetermined value for the loading pressure. It will send a signal to a switch-off device for the machine tool when the loading pressure attainable by the pressure device will reach or surpass, respectively, the predetermined value. As mentioned before, it will be prevented by the limitation of the loading pressure that the surface quality will deteriorate or an uncontrollable breaking up of the machining wheels is caused, respectively.

According to an embodiment of the invention, the sensor is a measuring feeler with which boundary switch points are associated for limiting a minimal or maximal, respectively, measuring sector. Thereby, it is prevented that the measuring becomes too imprecise. The signals of the boundary switches are preferably sent to the measuring control device which according to an embodiment of the invention will actuate the switch-off device of the machine or a warning lamp when it receives a signal from a boundary switch.

According to a further embodiment of the invention, a check station comprising a sensor is associated in a machine tool and the check feeler is connected with the measuring control device for modifying the predetermined value for the material removal of the workpiece or the switch-off time of the machine after reaching a predetermined value for the material removal. The workpieces are preferably removed from the machine by means of a suitable handling device and fed to the checking station.

An embodiment of the invention will be explained in the following referring to a drawing in which the only FIGURE diagrammatically shows a honing machine with a control arrangement according to the invention.

Before referring to the details in the drawing more closely it is stated that each of the described features per se or in combination with features of the claims is of significance for the invention.

A two-wheel honing machine 10 comprises an upper machining wheel 11 and a lower machining wheel 12. The upper machining wheel 11 is suspended at a spindle 13 at the upper end of which a driving wheel 14 is positioned which is driven by a driving motor 16 over a driving belt 15. The spindle 13 is supported in a supporting sleeve 44 which as an example is engaged by a loading device 18 over a lever system 17. By means of the loading device 18, the loading pressure of the machining wheel 11 may be adjusted. The members as described are supported in an upper member 19 which is pivotally supported around a vertical axis in the machine frame 20.

The lower machining wheel 12 is turnably supported in the machine frame 20 by means of a hollow spindle 21. The hollow spindle 21 is driven by an electric motor 23 over a driving belt 22. The lower machining wheel 12 is surrounded by a stationary pin wheel 24. Within the annular lower machining wheel 12, a plate 25 is arranged which is supported in the hollow spindle 21 over a spindle 26 and is connected with an electric motor 28 over a belt drive 27. The plate 25 comprises a pin wheel 29. A plurality of runner wheels 30 is arranged between the machining wheels 11, 12 supported on the lower machining wheel 12, the runner wheels being provided with a peripheral toothing which engages with the inner pin wheel 29 and the outer pin wheel 24. The runner wheels 30 will receive workpieces 31 in apertures, the upper and under sides of the workpieces being subject to machining. During the operation, the machining wheels 11, 12 will preferably rotate in opposite directions. Furthermore, the plate 25 is driven whereby the workpieces in the runner wheels 30 will move on a cycloidal path between the machining wheels 11, 12. Insofar, a common honing machine is being dealt with.

At the plate 25, there is a measuring surface 32 to which a measuring feeler 33 is associated. The measuring feeler 33 is connected with the upper machining wheel 11 and therefore will determine the distance of the machining wheel 11 from the stationary measuring surface 32. This distance depends on the thickness of the workpieces 31. However, it will also be influenced by the wear of the working surfaces of the upper and lower machining wheel 11, 12.

The measuring feeler 33 is connected with a measuring control device 35 over an electric circuit 34. The measuring control device comprises a programmable storage into which the values for a maximal material removal per time unit ($\delta/t$ max) and a minimal material removal per time unit $\delta/t$ min) are given. The measuring control device 35 is connected with a time impulse generator (not shown) which provides the time impulses (t) in the measuring control device. Furthermore, the values for a maximal and a minimal total material removal or range of measurement (max or min, resp.) are inserted into the programmable storage. The measuring control device 35 is connected with a pressure control device 37 by a circuit 36, the pressure control device being connected with a loading device 18 by a control line 38. The pressure control device 37 will control the pressure of a pressure fluid being supplied through a line 39, the fluid acting on the loading device 18 over line 38 (input pressure F; output pressure $F_B$). The pressure control device also comprises a programmable storage into which a maximal value for the differential pressure ($\Delta$Fmax) for a loading increase as well as a minimal differential pressure value ($\Delta$Fmin) for a loading decrease are stored.

A checking station 40 comprises two measuring feelers 41, the signals of which are sent to the measuring control device 35 over a circuit 42. The workpieces 31 are removed from the machine 10 by means of an automatic handling device (not shown) and fed to the checking station 40.

The arrangement as described will operate as follows. In machining given workpieces the values for the maximal and the minimal removal per time unit as well as the absolute values for the upper and the lower measuring range are fed into the measuring control device in the manner described above. The measuring feeler 33 will continuously or in time intervals provide a signal to the measuring control device 35 which is in relation to the respectively determined thickness. Now, the measuring control device will compare the values of the removal within a predetermined time range set by the time impulse generator. When the determined value is inbetween the maximal and the minimal removal value per time unit, the operation will be continued with the same loading pressure. This had been begun with a predetermined pressure $F_B$ for the upper machining wheel 11 which was set by the pressure control device 37 over the loading device 18. The workpieces 31 are automatically removed from the machine by means of a handling device and fed to the checking station 40. There, the thickness of the workpieces 31 again will be checked wherein the measuring signal will be sent to the measuring control device 35 over the circuit 42. The measuring control device has switched off the driving units of the machine 10 prior to the removal of the workpieces by means of a switch arrangement (not shown) as soon as it is indicated by the measuring feeler 33 that the required predetermined value for the material removal has been reached. As the measuring feeler 33 will not automatically compensate for the wear of the machining wheels 11, 12, a difference between the thickness values checked in the station 40 and the values may occur which are sent by the measuring feeler 33 to the measuring control device 35. The predetermined value for the workpiece thickness stored in the measuring control device 35 is modified correspondingly such that in this way, the wear of the machining wheel is compensated.

When the wear of the machining wheels 11, 12 increases, the grip thereof will decrease which means that the values for the material removal per time unit detected in the measuring control device 35 will get smaller. When they will fall below a minimal value ($\delta$/tmin), a signal is sent to the pressure control device over a circuit 36 which device thereupon will increase the pressure by an amount $\Delta$Fmax dependent on the value of the signal whereby the loading pressure of the upper machining wheel 11 will become larger. By setting the maximal value of the material removal per time unit ($\delta$/tmax)), it is attained that the pressure is increased in optimal pressure steps. The increasing material removal of the machining wheels and the longer operation time of the workpieces resulting therefrom will be continuously compensated by the pressure increase. However, the pressure may rise only to a maximal value in order not to result in an uncontrollable breaking up of the machining wheel. Furthermore, a too high pressure would deteriorate the quality of the surfaces. Therefore, when a predetermined upper pressure is reached, the machine will be stopped. The machining wheels 11, 12 have to be sharpened. As a matter of fact, a measuring feeler will operate with a relative accuracy only within a predetermined range. In order to maintain the range of accuracy, switching points ($\delta$max, $\Delta$min) (not shown) are associated with the measuring feeler 33 which provide for the switching off of the machine 10 or a warning signal, respectively, when the upper or lower limitation of the range is reached.

I claim:

1. A method for controlling the operation of a two-wheel honing machine wherein the machining wheels are pressed towards each other and onto the workpieces at a predetermined variable loading pressure by means of a loading device, wherein during operation the material removal of the workpieces and eventually of the machining wheels is determined by means of a measuring control device and the operation is discontinued after a predetermined value has been reached, characterized in that the thickness of material removal per time unit (actual value) is determined and compared with at least one predetermined value for the thickness of material removal per time unit and the loading pressure of the loading device is automatically increased when the actual value is below the predetermined value.

2. Method as claimed in claim 1, characterized in that a maximal and a minimal value for the thickness of material removal per time unit is predetermined and the loading pressure of the loading device is increased when the actual value of thickness of material removed is below the minimal predetermined value and is decreased when the actual value is above the maximal predetermined value.

3. Method as claimed in claim 2, characterized in that an alarm signal is delivered when the maximal predetermined value for the thickness of material removal has been reached.

4. Method as claimed in claim 3 wherein the thickness of the workpieces is checked after removal from the machine, characterized in that a correction signal is formed from the difference between the value checked and the predetermined value for modifying the predetermined value for the thickness of material removal or for the automatic shifting of the switch-off time of the machine after reaching the predetermined value for the thickness of material removal.

5. Method as claimed in claim 1 or 2, characterized in that the loading pressure is continuously varied dependent on the thickness of material removal per time unit.

6. Method as claimed in claim 5, characterized in that the magnitude of the change of the loading pressure depends on the magnitude of deviation of the actual value from the predetermined value for the thickness of material removal per time unit.

7. Method as claimed in claim 5, characterized in that the loading pressure is infinitely variable.

8. Method as claimed in claim 5, characterized in that the loading pressure is varied in firm predetermined steps.

9. Method as claimed in claim 5 wherein the thickness of the workpieces is checked after removal from the machine, characterized in that a correction signal is formed from the difference between the value checked and the predetermined value for modifying the predetermined value for the thickness of material removal or for the automatic shifting of the switch-off time of the machine after reaching the predetermined value for the thickness of material removal.

10. Method as claimed in claim 1 or 2, characterized in that the loading pressure is changed after completion of a working cycle and prior to the next working cycle.

11. Method as claimed in claim 10, characterized in that the magnitude of the change of the loading pressure depends on the magnitude of deviation of the actual value from the predetermined value for the thickness of material removal per time unit.

12. Method as claimed in claim 10, characterized in that the loading pressure is infinitely variable.

13. Method as claimed in claim 10, characterized in that the loading pressure is varied in firm predetermined steps.

14. Method as claimed in claim 10 wherein the thickness of the workpieces is checked after removal from the machine, characterized in that a correction signal is formed from the difference between the value checked and the predetermined value for modifying the predetermined value for the thickness of material removal or for the automatic shifting of the switch-off time of the machine after reaching the predetermined value for the thickness of material removal.

15. Method as claimed in one of the claims 1 or 2, characterized in that the magnitude of the change of the loading pressure depends on the magnitude of deviation of the actual value from the predetermined value for the thickness of material removal per time unit.

16. Method as claimed in claim 15, characterized in that the loading pressure is infinitely variable.

17. Method as claimed in claim 15, characterized in that the loading pressure is varied in firm predetermined steps.

18. Method as claimed in claim 15 wherein the thickness of the workpieces is checked after removal from the machine, characterized in that a correction signal is formed from the difference between the value checked and the predetermined value for modifying the predetermined value for the thickness of material removal or for the automatic shifting of the switch-off time of the machine after reaching the predetermined value for the thickness of material removal.

19. Method as claimed in one of the claims 1 or 2, characterized in that the loading pressure is infinitely variable.

20. Method as claimed in claim 19 wherein the thickness of the workpieces is checked after removal from the machine, characterized in that a correction signal is formed from the difference between the value checked and the predetermined value for modifying the predetermined value for the thickness of material removal or for the automatic shifting of the switch-off time of the machine after reaching the predetermined value for the thickness of material removal.

21. Method as claimed in one of the claims 1 or 2, characterized in that the loading pressure is varied in firm predetermined steps.

22. Method as claimed in claim 21 wherein the thickness of the workpieces is checked after removal from the machine, characterized in that a correction signal is formed from the difference between the value checked and the predetermined value for modifying the predetermined value for the thickness of material removal or for the automatic shifting of the switch-off time of the machine after reaching the predetermined value for the thickness of material removal.

23. Method as claimed in one of the claims 1 or 2 wherein the thickness of the workpieces is checked after removal from the machine, characterized in that a correction signal is formed from the difference between the value checked and the predetermined value for modifying the predetermined value for the thickness of material removal or for the automatic shifting of the switch-off time of the machine after reaching the predetermined value for the thickness of material removal.

24. Method as claimed in claim 23, characterized in that a mean value is formed from a plurality of check values.

25. A device for controlling the operation of a two-wheel honing machine of the type having a sensor for determining the material removal of the workpieces and eventually of the machining wheels and a loading device for variably adjusting the loading pressure preferably of an upper machining wheel, characterized in that an electronic measuring control device (35) with a programmable storage is provided into which at least one predetermined value for the thickness of material removal per time unit and for the total thickness of material removal is given, a time impulse generator is associated with the measuring control device (35), the sensor (33) is connected to the measuring control device (35) for the input of a signal corresponding with the thickness of material removal determined and the measuring control device (35) is connected to a pressure control device (37) for changing the loading pressure dependent on the signal of the measuring control device.

26. Device as claimed in claim 25, characterized in that the pressure control device comprises a programmable storage for predetermining a maximal predetermined value for the loading pressure and for sending a signal to a switch-off device for the machine (10) when the loading pressure attainable by the pressure device (18) reaches or surpasses, respectively, the predetermined value.

27. Device as claimed in claim 26 characterized in that the sensor is a measuring feeler (33) and boundary switch points for a minimal and maximal limitation of the measuring section are associated with the measuring feeler (33).

28. Device as claimed in claim 25 or 26, characterized in that the sensor is a measuring feeler (33) and boundary switch points for a minimal and maximal limitation of the measuring section are associated with the measuring feeler (33).

29. Device as claimed in claim 28, characterized in that the boundary switch points are connected with the measuring control device (35) and the device sends a signal to the switch-off device for the machine (10) when the device receives a signal from a boundary switch point.

30. Device as claimed in one of the claim 25, characterized in that a check station (40) comprising a sensor (41) is associated to the machine (10) and the sensor (41) is connected with the measuring control device (35) for modifying the predetermined value for the thickness of material removal of the workpiece (31) or the switch-off time of the machine (10) after having reached a predetermined value for the thickness of material removal.

31. Device as claimed in claim 30, characterized in that in addition to the check station (40) and the machine (10) a handling device is provided which automatically removes the workpiece (31) from the machine (10) and feeds it to the check station (40).

* * * * *

UNITED STATES PATENT AND TRADEMARK OFFICE

CERTIFICATE OF CORRECTION

PATENT NO. : 4,962,616

DATED : October 16, 1990

INVENTOR(S) : Gerhard Wittstock

It is certified that error appears in the above-identified patent and that said Letters Patent is hereby corrected as shown below:

Column 8, line 38, claim 28, delete "or 26".

Column 8, line 49, claim 30, change "claim 25" to --claims 25 to 29--.

In the Abstract, line 2, change "housing" to --honing--.

Signed and Sealed this

Eleventh Day of February, 1992

*Attest:*

HARRY F. MANBECK, JR.

*Attesting Officer*

*Commissioner of Patents and Trademarks*